US011656010B2

(12) United States Patent
Cho

(10) Patent No.: US 11,656,010 B2
(45) Date of Patent: May 23, 2023

(54) EVAPORATOR WITH FEED TUBE FLOW DISTRIBUTORS FOR RANDOM GRAVITATION AND ACCELERATION FIELDS

(71) Applicant: Hamilton Sundstrand Corporation, Charlotte, NC (US)

(72) Inventor: Wei-Lin Cho, Unionville, CT (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 216 days.

(21) Appl. No.: 16/890,121

(22) Filed: Jun. 2, 2020

(65) Prior Publication Data

US 2021/0372673 A1 Dec. 2, 2021

(51) Int. Cl.
*F25B 39/00* (2006.01)
*F25B 39/02* (2006.01)

(52) U.S. Cl.
CPC ..... *F25B 39/028* (2013.01)

(58) Field of Classification Search
CPC ..... F28B 39/028; F28D 7/12; F28D 1/0246; F28D 2021/0064; F28D 2021/0021; F28D 15/0266; F28D 2021/0071; F28D 15/046; F28F 9/0282; F28F 1/40; F28F 3/12; F28F 1/022; F28F 13/187; F28F 9/0273; F25B 39/028
See application file for complete search history.

(56) References Cited

U.S. PATENT DOCUMENTS

| | | | | |
|---|---|---|---|---|
| 2,611,584 A * | 9/1952 | Labus | F28D 7/12 165/142 |
| 2,816,738 A * | 12/1957 | McElgin | F28B 9/00 165/150 |
| 3,026,092 A | 3/1962 | Pellegini | |
| 4,007,601 A | 2/1977 | Webbon | |
| 5,651,268 A | 7/1997 | Aikawa et al. | |
| 9,097,470 B2 | 8/2015 | Chen et al. | |
| 9,651,314 B2 * | 5/2017 | Lee | F28F 1/40 |

(Continued)

FOREIGN PATENT DOCUMENTS

| | | |
|---|---|---|
| CN | 101782297 A | 7/2010 |
| EP | 0210337 A2 * | 2/1987 |
| EP | 0240337 A2 | 2/1987 |

(Continued)

OTHER PUBLICATIONS

The Extended European Search Report for Application No. 21174473.5-1002; Report dated Oct. 12, 2021; Report Received: Oct. 20, 2021; 7 pages.

*Primary Examiner* — Harry E Arant
(74) *Attorney, Agent, or Firm* — Cantor Colburn LLP

(57) ABSTRACT

An evaporator assembly including an inlet header, an outlet header, and an evaporator body extending from the inlet header to the outlet header. The evaporator body defining a channel fluidly connected to the outlet header. The evaporator assembly further includes a feed tube including: an adapter fluidly connected to the inlet header and a perforated tube fluidly connected to the inlet header through the adapter. The perforated tube including a first end attached to the adapter, a second end opposite the first end, and a plurality of orifices fluidly connecting the perforated tube to the channel. The perforated tube extends within the channel.

6 Claims, 5 Drawing Sheets

(56) References Cited

U.S. PATENT DOCUMENTS

| | | | |
|---|---|---|---|
| 2009/0000327 | A1 | 1/2009 | Burk et al. |
| 2011/0290465 | A1 | 12/2011 | Joshi et al. |

FOREIGN PATENT DOCUMENTS

| | | | |
|---|---|---|---|
| EP | 0798533 | A1 | 10/1997 |
| EP | 3067652 | A1 | 9/2016 |
| JP | 2004278935 | A | 10/2004 |
| WO | 9414021 | A1 | 6/1994 |

* cited by examiner

EVAPORATOR WITH FEED TUBE FLOW DISTRIBUTORS FOR RANDOM GRAVITATION AND ACCELERATION FIELDS

BACKGROUND

The subject matter disclosed herein relates generally to the field of evaporators, and specifically to an evaporator for terrestrial and microgravity environments.

Evaporators utilize latent heat of a fluid to absorb waste heat from a heat source. As such, in order to operate efficiently, an evaporating surface of an evaporator should be covered by a layer of a liquid phase of a working fluid as much as possible during operational conditions.

The liquid phase of a working fluid (i.e., liquid) tends to accumulate and move in the direction of gravity in a terrestrial environment. In a microgravity environment, liquid distribution is randomized and tends to move freely if undisturbed. Therefore, in each of these terrestrial and microgravity environment cases, it is often critical to replenish evaporating surfaces of evaporators with liquid.

BRIEF SUMMARY

According to one embodiment, an evaporator assembly is provided. The evaporator assembly includes an inlet header, an outlet header, and an evaporator body extending from the inlet header to the outlet header. The evaporator body defining a channel fluidly connected to the outlet header. The evaporator assembly further includes a feed tube including: an adapter fluidly connected to the inlet header and a perforated tube fluidly connected to the inlet header through the adapter. The perforated tube including a first end attached to the adapter, a second end opposite the first end, and a plurality of orifices fluidly connecting the perforated tube to the channel. The perforated tube extends within the channel.

In addition to one or more of the features described above, or as an alternative, further embodiments may include that the second end of the perforated tube is located in the outlet header.

In addition to one or more of the features described above, or as an alternative, further embodiments may include that the second end of the perforated tube is sealed off.

In addition to one or more of the features described above, or as an alternative, further embodiments may include that the plurality of orifices extend circumferentially around the perforated tube.

In addition to one or more of the features described above, or as an alternative, further embodiments may include that the plurality of orifices extend longitudinally along a selected length of the perforated tube.

In addition to one or more of the features described above, or as an alternative, further embodiments may include that the selected length is less than or equal to a length of the evaporator body.

In addition to one or more of the features described above, or as an alternative, further embodiments may include that the plurality of orifices start proximate the adapter and terminate before the outlet header.

In addition to one or more of the features described above, or as an alternative, further embodiments may include that the plurality of orifices extend helically around the perforated tube.

In addition to one or more of the features described above, or as an alternative, further embodiments may include that the plurality of orifices are arranged circumferentially around the perforated tube at a plurality of locations longitudinally along a selected length of the perforated tube.

In addition to one or more of the features described above, or as an alternative, further embodiments may include that the channel includes grooves respectively delimited by first and second interior facing sidewalls of the evaporator body which form a base and an apex with an apex angle opposite the base and defined such that, for a fluid flow moving through the channel in a microgravity environment: a portion of the fluid flow in a liquid phase within a groove of the channel will move in the groove from the base to the apex, and a portion of the fluid flow in a vapor phase within a groove of the channel will move in the groove from the apex to the base.

In addition to one or more of the features described above, or as an alternative, further embodiments may include that the groove circumferentially arrayed to extend outwardly from an open central region where the perforated tube is located.

In addition to one or more of the features described above, or as an alternative, further embodiments may include that the apex angle is $2\beta$ and $\beta$ is less than 90° minus a solid-liquid contact angle.

In addition to one or more of the features described above, or as an alternative, further embodiments may include a fluid pump fluidly connected to the inlet header. The fluid pump being configured to deliver a working fluid at a selected pressure to maintain the working fluid through an entirety of the perforated tube.

In addition to one or more of the features described above, or as an alternative, further embodiments may include that the adapter is configured to block working fluid from migrating from the channel into the inlet header.

According to another embodiment, a feed tube for an evaporator assembly is provided. The feed tube including an adapter and a perforated tube connected to the adapter. The perforated tube including a first end attached to the adapter, a second end opposite the first end, and a plurality of orifices.

In addition to one or more of the features described above, or as an alternative, further embodiments may include that the second end of the perforated tube is sealed off.

In addition to one or more of the features described above, or as an alternative, further embodiments may include that the plurality of orifices extend circumferentially around the perforated tube.

In addition to one or more of the features described above, or as an alternative, further embodiments may include that the plurality of orifices extend longitudinally along a selected length of the perforated tube.

In addition to one or more of the features described above, or as an alternative, further embodiments may include that the plurality of orifices extend helically around the perforated tube.

In addition to one or more of the features described above, or as an alternative, further embodiments may include that the plurality of orifices are arranged circumferentially around the perforated tube at a plurality of locations longitudinally along a selected length of the perforated tube.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Movement of a working fluid of an evaporator in a microgravity environment is mainly dictated by a surface tension of the working fluid, characteristics of a surface the working fluid is intended to be in contact with and external disturbances applied to the system. In a terrestrial environment, the working fluid will tend to pool and flow in the direction of gravity. In either case, in a properly designed groove, working fluid can be replenished into the groove and vapor can be expelled out of the groove at similar rates which is useful in the replenishment of working fluid on an evaporating surface of an evaporator. As such, as will be described below, a groove geometry in which working fluid can be replenished into the groove and vapor can be expelled out of the groove at similar rates in integrated into an evaporator design. The evaporator design, according to one or more embodiments, is therefore suitable for both terrestrial and microgravity environments.

Additionally for a long evaporator oriented against gravity or under an adverse acceleration load, the working fluid may not be able to wet the entire length of the evaporator, and thus the evaporator will not have the designed efficiency of the temperature uniformity. The embodiments disclose herein seek to correct this inefficiency by allowing the working fluid to wed the entire length of the evaporator using a perforated tube installed along the length of the evaporator.

Figure 1:
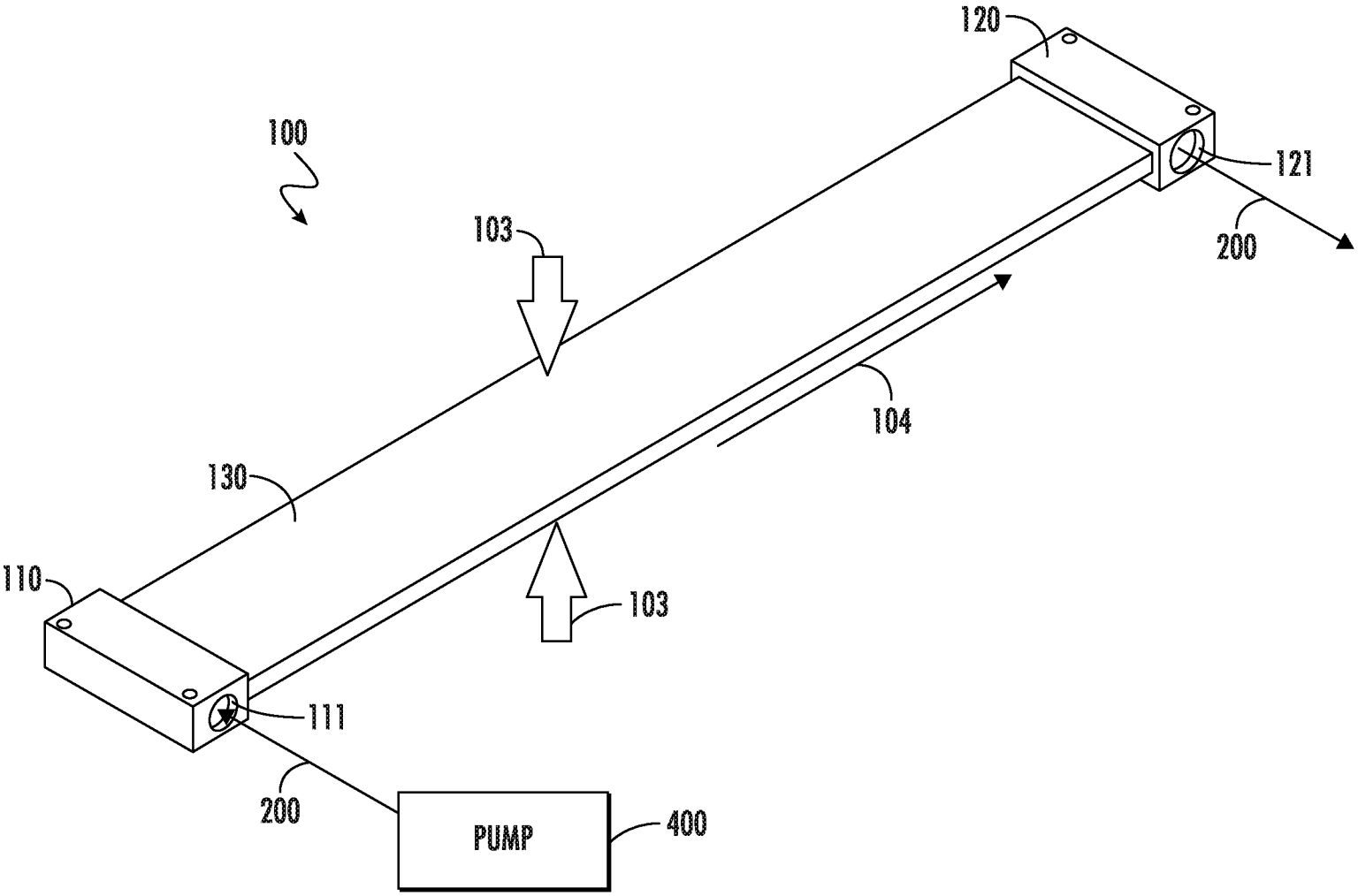
FIG. 1 is a perspective view of an evaporator assembly, in accordance with an embodiment of the present disclosure.

Referring now to FIG. 1, an isometric view of an evaporator assembly 100 is illustrated, according to an embodiment of the present disclosure. The evaporator assembly 100 includes an inlet header 110, an evaporator body 130, and an outlet header 120. The evaporator body 130 is interposed between the inlet header 110 and the outlet header 120 and extends from the inlet header 110 to the outlet header 120. The evaporator body 130 is the evaporating element of the evaporator assembly 100. A fluid pump 400 is fluidly connected to the inlet header at the inlet 111. The pump 400 is configured to deliver a working fluid 200 to the evaporator assembly 100 at a selected pressure. The working fluid 200 enters the inlet header 110 at an inlet 111. The working fluid 200 then flows from the inlet header 110 to the outlet header 120 through the evaporator body 101 in a flow direction 104. The working fluid 200 absorbs heat 103 from a heat source while flowing through the evaporator body 130. The fluid then exits the outlet header 120 through an outlet 121 at the outlet header 120.

Figures 2, 3, 4:
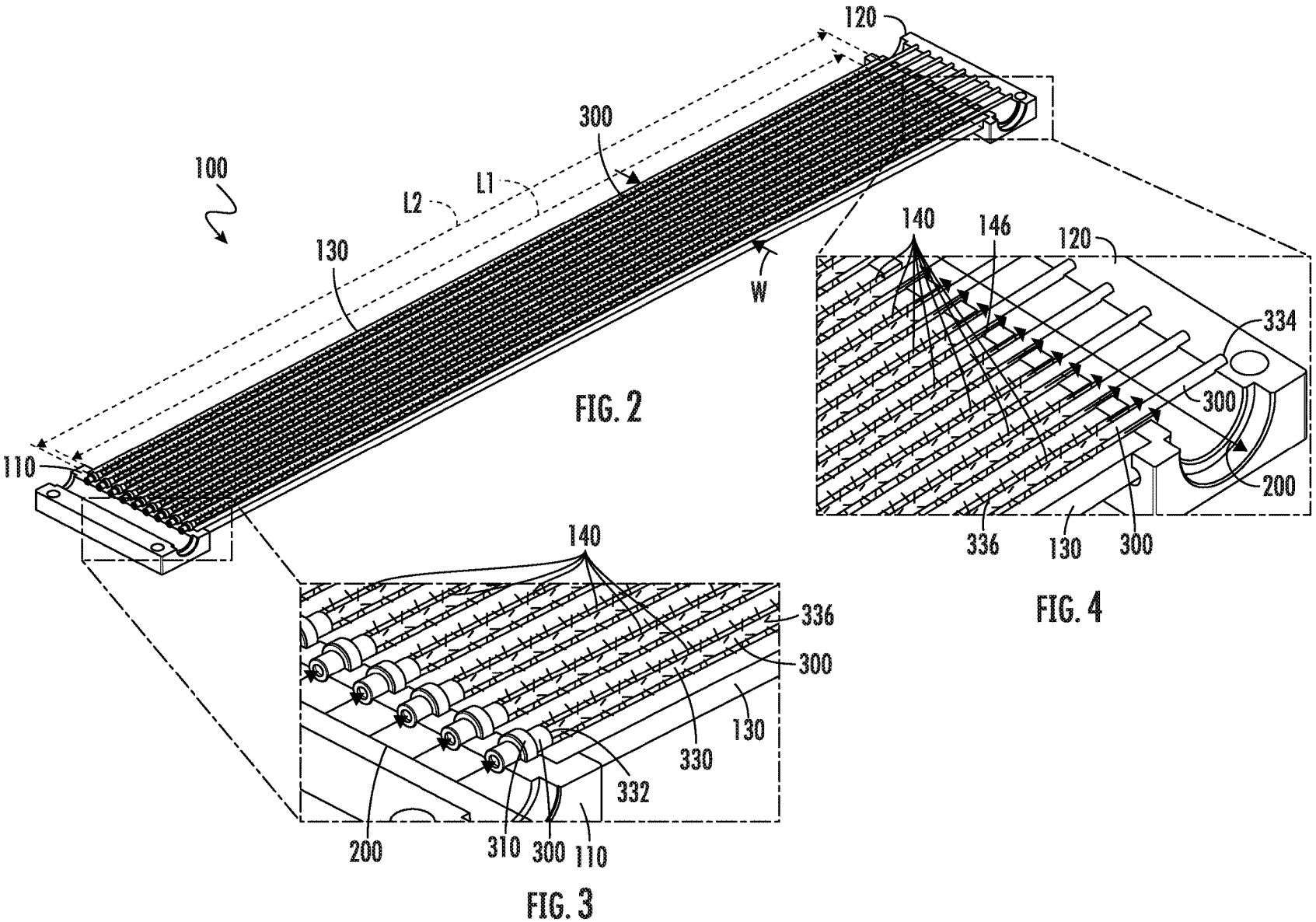
FIG. 2 is a cutaway view of the evaporator assembly, in accordance with an embodiment of the present disclosure.
FIG. 3 is an enlarged cutaway view of an inlet header of the evaporator assembly of FIG. 2, in accordance with an embodiment of the present disclosure.
FIG. 4 is an enlarged cutaway view of an outlet header of the evaporator assembly of FIG. 2, in accordance with an embodiment of the present disclosure.

Referring now to FIGS. 2-4, with continued reference to FIG. 1, a cutaway view of the evaporator assembly 100 is illustrated, according to an embodiment of the present disclosure. The working fluid 200 is conveyed from the inlet header 110 to the evaporator body 130 through a feed tube 300. It is understood that, although discussed herein in the singular tense, the evaporator assembly 100 may include multiple feed tubes 300, as illustrated in FIGS. 2-4. The feed tube 300 is composed of an adapter 310 and a perforated tube 330. The adapter 310 fluidly connects the feed tube 300 to the inlet header 110.

The perforated tube 330 may be tubular in shape as illustrated in FIGS. 2-4. The perforated tube 330 includes a first end 332 and a second end 334 opposite the first end 332. The perforated tube 330 extends within and through a channel 140 formed within the evaporator body 130. The perforated tube 330 is fluidly connected to the adapter 310 at the first end 332 such that the working fluid 200 may flow from the inlet header 110 into the first end 332 of the perforated tube 330 through the adapter 310. The first end 332 is attached to the adapter 310. In an embodiment, the second end 334 of the perforated tube 330 is located in the outlet header 120, as illustrated in FIG. 4. In an embodiment, the second end 334 is sealed off or closed, such that no working fluid 200 exits the perforated tube 330 at the second end 334.

The perforated tube 330 extends within the evaporator body 130 through a channel 140 defined in the evaporator body 130. The evaporator body 130 is formed to define channels 140 that may be arranged in a linear formation 141 across a width W of the evaporator body 130. Each of the channels 140 can have a substantially same shape as the others.

The perforated tube 330 includes a plurality of orifices 336 along a selected length L1 of the perforated tube 330. The selected length L1 may be less than an overall length of the perforated tube 330. As illustrated in FIGS. 2-4, the selected length L1 does not extend from the first end 332 to the second end 334 but rather the selected length L1 is about equal to or less than a length L2 of the evaporator body 130. The plurality of orifices 336 start proximate the adapter 310 or right after the adapter 310 but terminate before the outlet header 130. There are no orifices 336 located in a portion of the perforated tube 330 that is located in the outlet header 120, as illustrated in FIG. 4. In other words, the orifices 336 stop or cease to exist once the perforated tube 330 enters the outlet header 120. The orifices 336 fluidly connect the perforated tube 330 to the channel 140. The orifices 336 are configured to provide the working fluid 200 to the channels 140 of the evaporator body 130. The orifices 336 are configured to provide the working fluid 200 to the channels 140 in liquid form, where the heat 103 may transform at least a portion of the working fluid 200 to vapor form. The working fluid 200 then migrates from the channels 140 into the outlet header 120 at a channel outlet 146. The channel outlet 146 fluidly connects the channel 140 to the outlet header 120. The adapter 310 prevents or blocks the working fluid 200 from migrating from the channel 140 into the inlet header 110. In other words, the adapter 310 fluidly separates the channel 140 and the inlet header 110.

In order to ensure that the evaporator assembly 100 can operate as efficiently as possible under any gravitational or acceleration load from any direction, the evaporative surfaces within the channel 140 of the evaporator body 130 may be continuously supplied with the working fluid 200 in a liquid phase.

The pump 400 (see FIG. 1) is configured to deliver the working fluid 200 into the inlet 111, then to the inlet header 110, then into the adapter 310, and then into the perforated tube 330 at a selected pressure in a liquid form. The selected pressure is high enough to maintain working fluid 200 throughout an entirety of the perforated tube 330 at all times. In other words, the perforated tube 330 is always filled with working fluid 200 (i.e., completely filled).

Advantageously, since the perforated tube 330 is always filled with working fluid 200, the gravitation and the acceleration loads of any magnitude from any direction will not have any significant effect to the fill condition of the perforated tube 330 as long as the pump 400 is capable of generating enough pressure head to overcome the total system pressure drop.

Figure 5:
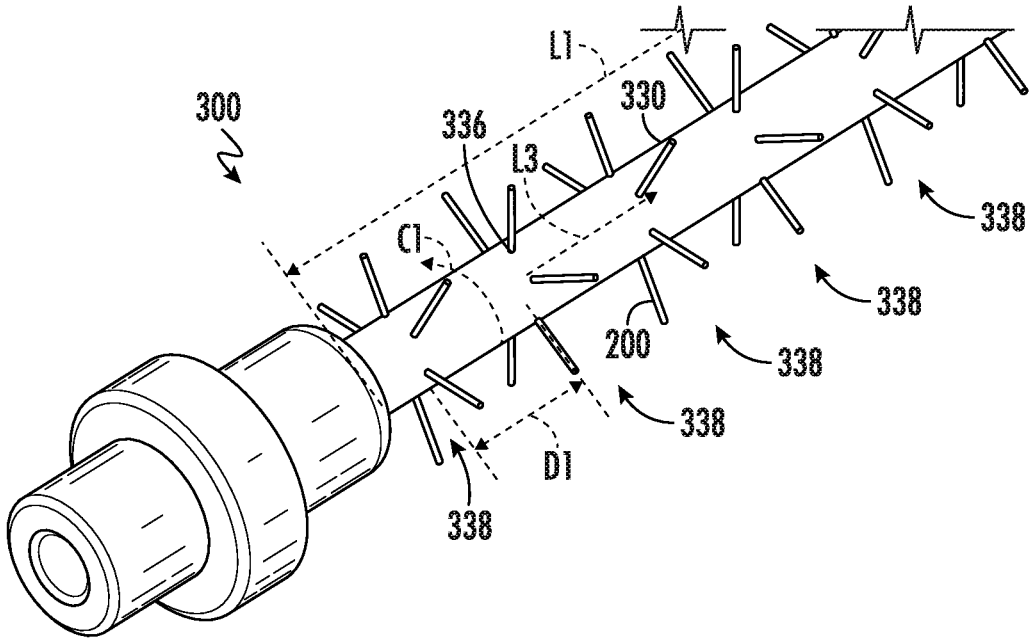
FIG. 5 is an isometric view of a feed tube of the evaporator assembly, in accordance with an embodiment of the present disclosure.
Figure 6:
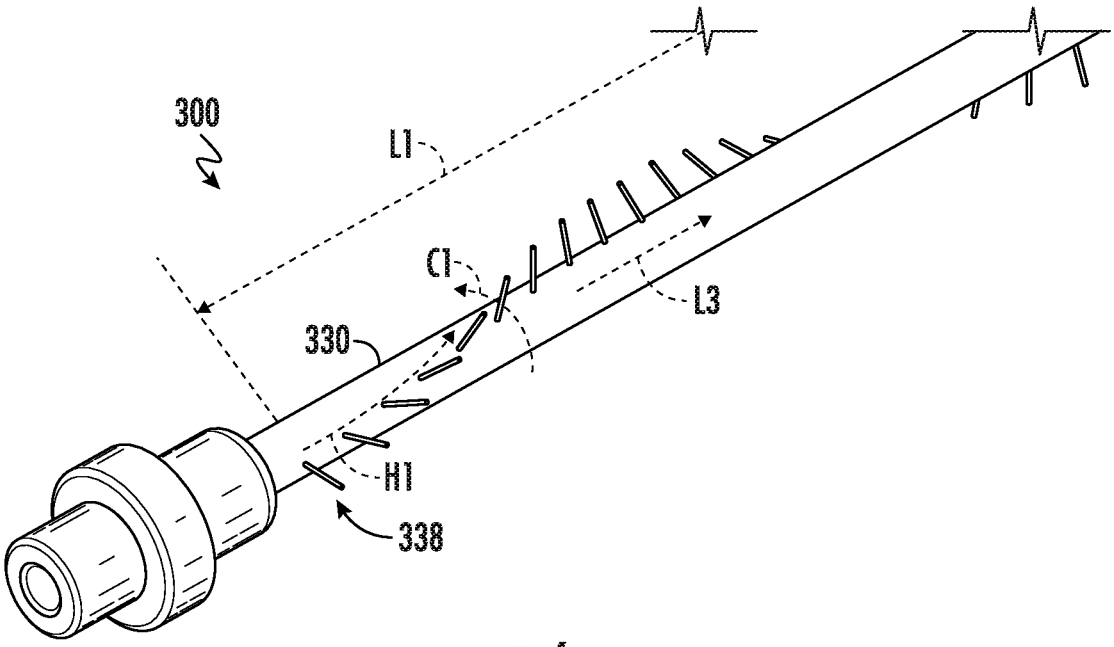
FIG. 6 is an isometric view of a feed tube of the evaporator assembly, in accordance with an embodiment of the present disclosure.

Referring now to FIGS. 5 and 6, different patterns of orifices 336 are illustrated, in accordance with an embodiment of the present disclosure. It is understood that while two patterns of orifices 336 are illustrated in FIGS. 5 and 6, the embodiments disclosed herein may be applicable to any pattern of orifices 336. Some examples for other patterns may include but are not limited to a single row, multiple one-sided rows, partial areal coverage, or any other pattern conceivable by one of skill in the art.

FIG. 5 illustrates a plurality of orifices 336 arranged circumferentially C1 around the perforated tube 330 at a plurality of locations 338 longitudinally L3 along the selected length L1 of the perforated tube 330. In other words, at each location 338 there the orifices 366 arranged circumferentially C1 around the perorated tube 330. There may be any number of orifices 336 at each location 338. In an embodiment, there may be six orifices 336 at each location 338, but it is understood that the embodiments disclosed herein may be applicable to more or less than six orifices at each location 338. The number of orifices 336 at each location may be equivalent to a number of grooves 142 (See FIGS. 7-10) in each channel 140. The orifices 336 may be aligned with each groove 142 such that working fluid 200 from the orifices 336 may be directed into the groove 142. The number of orifices 336 may vary but there may be enough orifices 336 such that the working fluid 200 can cover the evaporative surfaces of the channel 140. The orifices 336 are sized such that the flow of working fluid 200 is high enough to reach the evaporative surfaces of the channel 140. The evaporative surfaces includes the grooves 142. The orifices 336 may be intermittently spaced or regularly spaced circumferentially C1 around the perforated tube 330 at each location 338. The locations 338 may be intermittently spaced or regularly spaced (e.g., D1 is the same between each location) longitudinally L3 along the selected length L1 of the perforated tube 330.

FIG. 6 illustrates a plurality of orifices 336 arranged in helically H1 around the perforated tube 330. There may be one orifices 336 at each location 338 as the plurality of orifices 336 winds helically H1 around the perforated tub 330. In other words, the plurality of orifices 336 are arranged in a line that winds circumferentially C1 around the perforated tube 330 while traversing longitudinally L3 along the selected length L1 of the perforated tube 330.

Advantageously, the orifices 336 within the perforated tube 330 can be designed to have any pattern as long as the liquid stream of working fluid 200 emanating from the orifices 336 can cover the channel 140, which is a heat input surface of the evaporator body 130.

Figure 7:
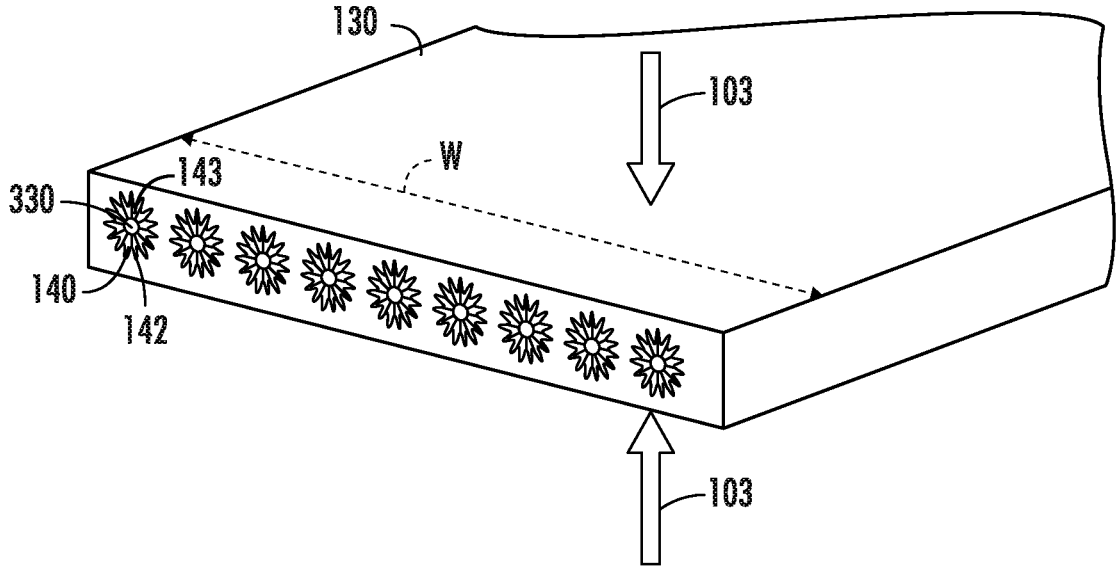
FIG. 7 is a perspective view of a body and channels of the evaporator assembly of FIG. 1, in accordance with an embodiment of the present disclosure.
Figure 8:
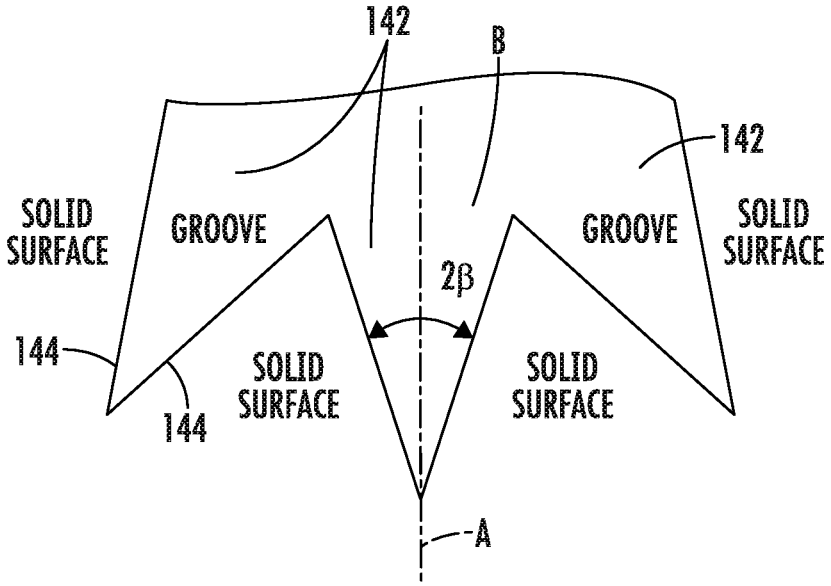
FIG. 8 is an axial view illustrating a configuration of grooves of the channels of FIG. 7, in accordance with an embodiment of the present disclosure.

Referring now to FIGS. 7 and 8, with continued reference to FIGS. 1-6, grooves 142 formed within the channels 140 of the evaporator body 130 are illustrated, according to an embodiment of the present disclosure. The evaporator body 130 is formed to define channels 140 that may be arranged in a linear formation across a width W of the evaporator body 130. Each of the channels 140 can have a substantially same shape as the others and includes grooves 142 that are circumferentially arrayed to extend radially outwardly from an open central region 143 where the perforated tube 330 is located.

Each of the grooves 142 has a same shape as the others and is immediately adjacent to neighboring grooves 142. In addition, each of the grooves 142 is delimited by first and second interior facing sidewalls 144 of the evaporator body 130. The first and second interior facing sidewalls 144 are tapered toward each other to form a base B and an apex A. The apex A is opposite the base B and has an apex angle $2\beta$ where $\beta$ is less than 90° minus a solid-liquid contact angle. That is, the apex angle $2\beta$ is defined such that, for a fluid flow moving through one of the channels 140 in a microgravity environment where a portion of the fluid flow is in a liquid phase and another portion of the fluid flow is in a vapor phase, the portion of the fluid flow in the liquid phase within a particular groove 142 of the channel 140 will move in the particular groove 142 from the base B to the apex A and the portion of the fluid flow in the vapor phase within the particular groove 142 will move in the particular groove 142 from the apex A to the base B.

Figure 9:
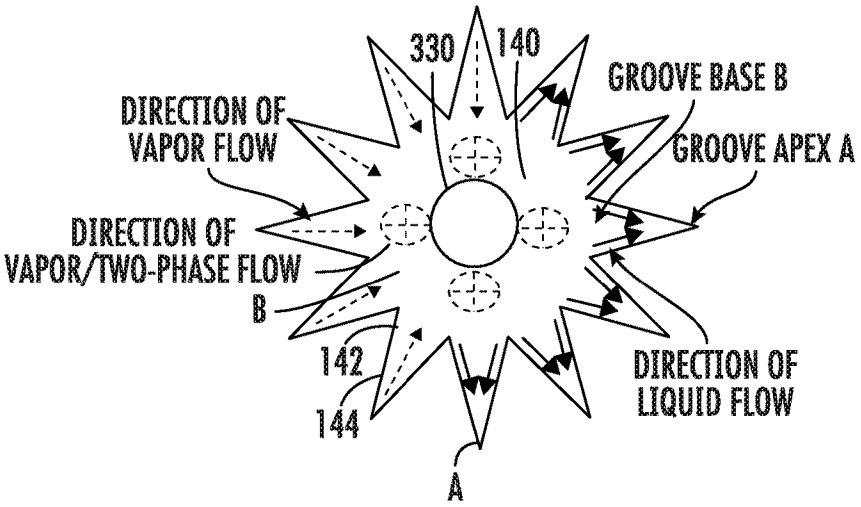
FIG. 9 is an illustration of an operation of the groove channels of FIG. 7 in a microgravity environment, in accordance with an embodiment of the present disclosure.

Referring now to FIG. 9, with continued reference to FIGS. 1-8, an operation of the channels 140 and the grooves 142 in a microgravity environment is illustrated, in accordance with an embodiment of the present disclosure. As shown in FIG. 9, in the microgravity environment, once liquid contacts the first and second interior facing sidewalls 144 of each of the grooves 142, the liquid moves in the direction from the base B and to the apex A. After vaporization by exposure of the evaporator body 130 to heat 103, the vapor is expelled from the apex A toward the base B and to the open central region 143 where the perforated tube 330 is located.

Figure 10:
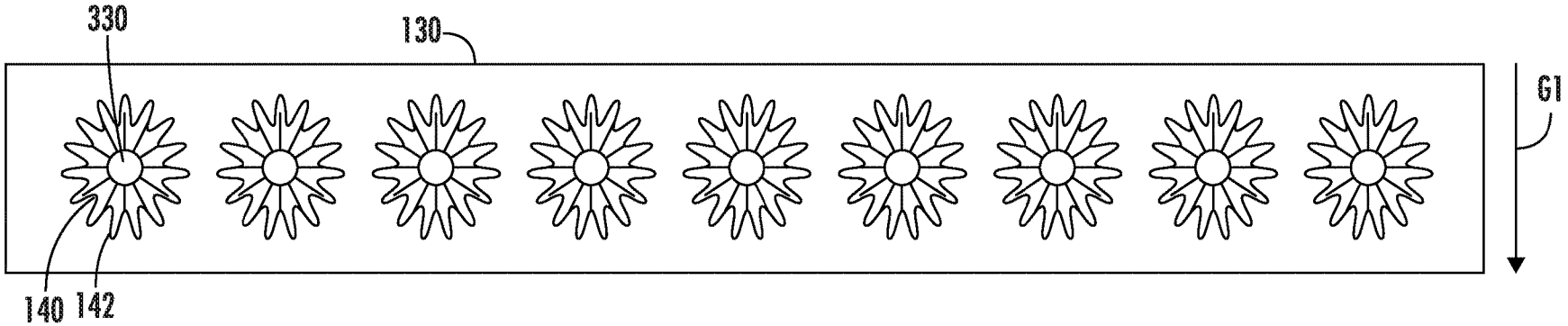
FIG. 10 is an illustration of an operation of the groove channels of FIG. 7 in a gravity field, in accordance with an embodiment of the present disclosure.

Referring now to FIG. 10, with continued reference to FIGS. 1-9, an operation of the channels 140 and the grooves 142 in a gravity field G1 is illustrated, in accordance with an embodiment of the present disclosure. As shown in FIG. 10, the gravity field G1 does not affect the distribution of the working fluid 200 to grooves 142 of the channels 140 because the working fluid 330 is pressurized and is directed out of the perforated tube 330 towards the grooves 142.

Therefore, more heat transfer may occur between the evaporator body 130 and the working fluid 330 because the working fluid 200 is not susceptible to the gravity field G1.

Technical effects and benefits of the features described herein include utilizing pressurized perforated tubes to more equally distribute a working fluid in liquid form across a heat transfer surface of an evaporator in both microgravity environments and terrestrial environments.

A detailed description of one or more embodiments of the disclosed apparatus and method are presented herein by way of exemplification and not limitation with reference to the Figures.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. An evaporator assembly, comprising:

an inlet header; an outlet header;

an evaporator body extending from the inlet header to the outlet header and between first and second sides across a width of the evaporator body, the evaporator body being solid and defining channels that are adjacent to each other between the first and second sides of the evaporator body and extend from the inlet header to the outlet header in a linear formation along their entire length to fluidly connected to the inlet and outlet headers, each of the channels being fluidly separate from each other and having a same shape as each other, each channel of the channels comprises:

grooves respectively delimited by first and second interior facing sidewalls of the evaporator body which form a base and an apex with an apex angle opposite the base;

a feed tube that extends therein with unfilled space between the feed tube and the base of the grooves of the channel, the feed tube comprising:

an adapter fluidly connected to the inlet header; and a perforated tube extending in the linear formation along its entire length within the channel and fluidly connected to the inlet header through the adapter, the perforated tube comprising:

a first end attached to the adapter at the header inlet, a second end at the header outlet that is opposite the first end, and orifices fluidly connecting the perforated tube to the channel, the orifices start at the adapter and extend longitudinally along a selected length of the perforated tube that is less than a length of the evaporator body, and terminate before the outlet header, and the second end of the perforated tube is sealed, thereby preventing fluid from exiting the perforated tube at the second end, and at each of a plurality of discrete locations longitudinally along the perforated tube, there are a plurality of the grooves in the channel and a same number of the orifices circumferentially distributed in the perforated tube, and each of the orifices is aligned with one of the grooves.

2. The evaporator assembly of claim 1, wherein the plurality of orifices that are extend helically distributed around the perforated tube, wherein at each of the plurality of discrete locations longitudinally along the perforated tube, there are the plurality of the grooves in the channel and the same number of the orifices that are helically distributed in the perforated tube, and each of the orifices is aligned with one of the grooves.

3. The evaporator assembly of claim 1, wherein the channel comprises the grooves respectively delimited by first and second interior facing sidewalls of the evaporator body which form the base and the apex with the apex angle opposite the base and are defined such that, for a fluid flow moving through the channel in a microgravity environment:

a portion of the fluid flow in a liquid phase within a groove of the channel will move in the groove from the base to the apex, and a portion of the fluid flow in a vapor phase within a groove of the channel will move in the groove from the apex to the base.

4. The evaporator assembly of claim 3, wherein the groove circumferentially arrayed to extend outwardly from an open central region where the perforated tube is located.

5. The evaporator assembly of claim 1, further comprising:

a fluid pump fluidly connected to the inlet header, the fluid pump being configured to deliver a working fluid at a selected pressure to maintain the working fluid through an entirety of the perforated tube.

6. The evaporator assembly of claim 1, wherein the adapter is configured to block working fluid from migrating from the channel into the inlet header.

* * * * *